US006476839B1

(12) United States Patent
Nakajima et al.

(10) Patent No.: US 6,476,839 B1
(45) Date of Patent: Nov. 5, 2002

(54) THERMAL PRINTER AND HEAT HISTORY CONTROL METHOD

(75) Inventors: Satoshi Nakajima, Horigane-mura; Satoru Imai, Suwa, both of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/621,785

(22) Filed: Jul. 21, 2000

(30) Foreign Application Priority Data

Jul. 21, 1999 (JP) ..... 11-206540

(51) Int. Cl.[7] ..... B41J 2/36; B41J 2/355

(52) U.S. Cl. ..... 347/195; 347/176

(58) Field of Search ..... 347/171, 172, 347/175, 176, 180, 181, 182, 195; 400/120.02, 120.03, 120.04, 120.15, 120.09

(56) References Cited

U.S. PATENT DOCUMENTS

| | | | |
|---|---|---|---|
| 4,639,743 | A | 1/1987 | Sakura et al. |
| 4,814,790 | A | 3/1989 | Nitta |
| 4,912,485 | A | 3/1990 | Minowa |
| 5,841,461 | A | 11/1998 | Katsuma |

FOREIGN PATENT DOCUMENTS

| | | |
|---|---|---|
| EP | 0 193 343 | 9/1986 |
| EP | 0 391 689 A2 | 10/1990 |
| JP | 61-195863 | 8/1986 |
| JP | 6-64211 | 3/1994 |
| JP | 9-327939 | 12/1997 |
| JP | 10-23276 | 1/1998 |
| JP | 10-93792 | 4/1998 |
| JP | 2836584 | 10/1998 |

*Primary Examiner*—Huan Tran
(74) *Attorney, Agent, or Firm*—Mark P. Watson

(57) ABSTRACT

The present invention provides in a line thermal printer for producing different colors in a print medium according to a level of heat energy applied to the print medium: storage buffers B1 to B4 having a plurality of areas for storing a line of print pixel data according to the number of plural heating elements for forming print pixels; a control circuit for identifying whether the printer is set to a monochrome mode or a multicolor mode; a CPU 21 for storing to the storage buffers B1 to B4 the next line of print pixel data to be printed and one or a plurality of lines of print pixel data printed immediately before (when the printer is set to the monochrome mode), and storing to the storage buffers B1 to B4 at least a next line of print pixel data of each color to be printed when the printer is set to the multicolor mode; and a drive data generator 22, 23 for outputting data determining the drive time of each drive circuit of the heating elements based on data stored in the storage buffers. Thus the present invention can provide a line thermal printer capable of switching between monochrome and multicolor printers, and accomplishing high quality monochrome printing with consideration given to a printing history, and also printing in multiple colors.

24 Claims, 10 Drawing Sheets

THERMAL PRINTER AND HEAT HISTORY CONTROL METHOD

BACKGROUND OF THE INVENTION

1. Field of the Invention

Our invention relates to a thermal printer for imparting onto a recording medium a different color or tone of color according to the level of heat energy imparted to the recording medium.

2. Description of the Related Art

Line thermal printers and other types of thermal printers have numerous independently heat-driven thermal elements arranged in line, and print by selectively driving these thermal elements to impart heat to the corresponding position of an oppositely positioned heat sensitive paper, thereby causing the heat sensitive paper to change color. The color produced in the heat sensitive paper by this type of printer differs according to the amount of heat energy imparted by the thermal element. As a result, actual print results, such as the color density, will also differ according to whether or not a selected thermal element was driven immediately before, i.e. whether or not a selected thermal element has residual heat.

A typical method of avoiding such problems and improving print quality has been to store past printed pixel data as a print history. This print history is then used to vary the next pulse width applied to a particular thermal element and adjust the thermal element drive time.

FIG. 10 is a control block diagram of a conventional line thermal printer in which this print history is used as noted above. One dot line unit of print pixel data received from a host is temporarily stored in a print buffer 1, and sent to a print head unit 10 by way of selector 4. When a next dot line of print pixel data is stored in the print buffer 1, the current data in the print buffer 1 is first moved to a history buffer 2. The data stored in history buffer 2 and data stored in print buffer 1 are then operated on bit by bit by logic circuit 3, and output to selector 4. The selector 4 is a type of sequencer and sequentially outputs data from print buffer 1 and data from logic circuit 3 according to a data selection signal from control circuit section 5. More specifically, the strobe period is divided into a part (period 1) for passing data from print buffer 1, and a part (period 2) for passing data from the logic circuit 3 During period 1 the data selection signal applies data from the print buffer 1 to the print head unit 10, and during period 2 applies data from the logic circuit 3 to the print head unit 10.

Another technique for color printing with a thermal printer is taught, for example, in Japanese Patent 2836584. In this technique the heat sensitive paper is manufactured with layers of different colors, and a particular color is printed by changing the heat energy applied by a particular thermal element. To print one color in this type of printer, the pulse width of the thermal element drive circuit is lengthened so that a high level of heat energy is applied, and to print another color, the pulse width is shortened so that a low level of energy is applied. While this technology can also be used for single color printing with multiple gradations, it is still necessary vary the pulse width according to the desired gradation.

Considering these problems with multigradient thermal printing using a print history as described above, it is very difficult to directly apply this heat history control technique to printing in many colors or many tones in single color printing because of the increasing complexity of the print history. A line thermal printer that can switch between high quality single color printing using a print history, and printing in multiple colors, is also desirable. Achieving such a line thermal printer requires technology for flexibly controlling a buffer for storing history data for each print pixel, and particularly requires technology for efficiently sharing the buffer between single color printing and printing in multiple colors (multicolor printing).

OBJECTS OF THE INVENTION

An object of our invention is to provide a method for easily realizing heat history control even in a printing method for producing multiple colors.

A further object is to provide a line thermal printer capable of switching between high quality single color printing considering the print history, and multicolor printing.

Yet a further object is to provide a method for efficiently sharing a buffer storing print pixel data for use in single color printing and multicolor printing in a line thermal printer of this type.

SUMMARY OF THE INVENTION

To achieve the above objects, we provide in a thermal printer that prints on a recording medium in which plural colors can be produced depending upon the heat energy applied to the recording medium: a thermal element for producing the plural colors; a thermal element drive circuit that drives the thermal element; a receiving circuit for receiving color data specifying either no color or one of the plural colors; memory for storing the color data received by the receiving circuit; and a drive control circuit for supplying a particular drive signal to the thermal element drive circuit based on the current color data received by the receiving circuit, and previous color data stored in memory.

This thermal printer further preferably has in its memory a first storage part for storing presence or absence of first color data based on color data received by the receiving circuit, and a second storage part for storing presence or absence of second color data based on color data received by the receiving circuit.

Yet further preferably, the first and second storage parts of the memory respectively store the presence or absence of current and previous first color data, and the presence or absence of current and previous second color data.

Yet further preferably, the drive control circuit is divided into plural parts and defines a strobe period of the drive circuit, and has a logic circuit for determining whether, current is applied to the thermal element during the plural strobe period parts based on at least presence or absence of current first color data, presence or absence of previous first color data, presence or absence of current second color data, and presence or absence of a previous second color data.

Yet further preferably, the thermal printer in this case also has a color mode setting circuit for setting a color mode, and a memory allocation circuit for determining the color data to be stored in memory according to the color mode set by the color mode setting circuit. In this case the drive control circuit supplies a different control signal to the thermal element drive circuit according to the color mode set by the color mode setting circuit.

Further preferably in this case, when a dual color mode is set, the memory allocation circuit stores in memory the presence or absence of first color data, and the presence or absence of the second color data, based on color data received by the receiving circuit. When a single color mode is set, the memory allocation circuit stores the presence or absence of only the first color data in memory based on the color data received by the receiving circuit.

Further preferably, when the dual color mode is set, the memory allocation circuit stores in memory the presence or absence of current and previous first color data, and the presence or absence of current and previous second color data, based on color data received by the receiving circuit. When the single color mode is set, the memory allocation circuit stores the presence or absence of previous first color data in memory instead of storing the presence or absence of current and previous second color data.

The drive control circuit of this thermal printer further preferably has a first strobe period dividing circuit for dividing the drive circuit strobe period into first specific plural parts, a first logic circuit, a second strobe period dividing circuit for dividing the drive circuit strobe period into second specific plural parts, and a second logic circuit. This first logic circuit determines whether current is applied to the thermal element during the first specific plural parts based on at least presence or absence of current first color data, presence or absence of a previous first color data, presence or absence of current second color data, and presence or absence of a previous second color data. The second logic circuit determines whether current is applied to the thermal element during the second specific plural parts based on at least presence or absence of a current first color data, and presence or absence of a previous first color data. In this thermal printer the first strobe period dividing circuit and first logic circuit are preferably selected when the dual color mode is set. When the single color mode is set, the second strobe period dividing circuit and second logic circuit are preferably selected.

Yet further preferably in each of the above cases, the drive control circuit sets the period from one strobe to the next strobe according to the color mode set by the color mode setting circuit.

It will also be evident that our invention is also extremely useful provided as a thermal history control method with control steps corresponding to the functional and operative elements of a printer configured as above.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
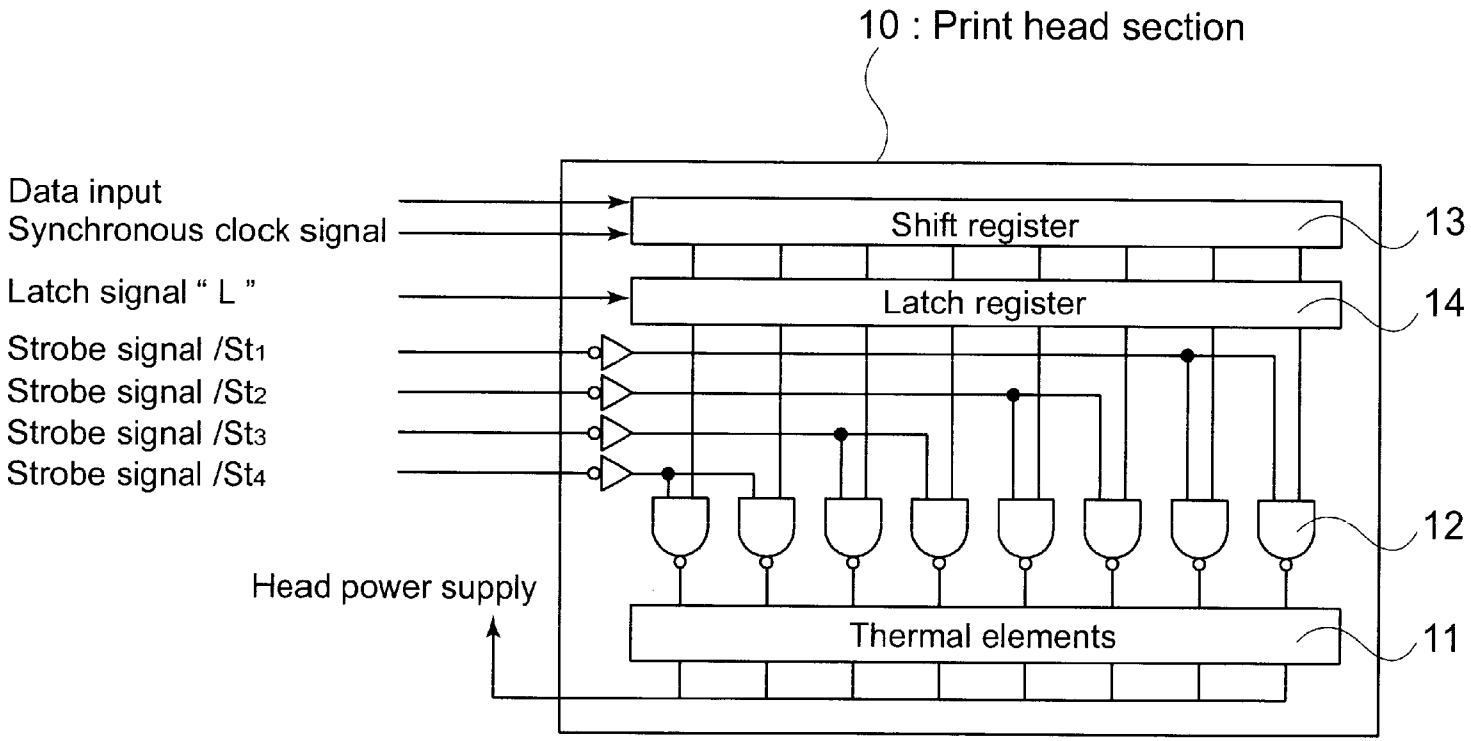
FIG. 1 is a block diagram of a print head in a line thermal printer according to a preferred embodiment of the present invention.

A preferred embodiment of the present invention is described next below with reference to the accompanying figures. FIG. 1 is a block diagram of the print head unit of a line thermal printer according to the present invention.

As shown in this figure, print head unit 10 of the printer has a heat emitting body 11 having a large number of thermal elements (resistors) for simultaneously printing one line unit of print pixel data. This heat emitting body 11 is arranged at the edge of a print head extending widthwise to the thermal paper print medium, and simultaneously forms one line of pixels on the paper by selective thermal driving of the thermal elements. A plurality of drive circuits 12 for independently thermal driving each of the thermal elements is connected to the heat emitting body 11. Each drive circuit 12 can be an npn transistor. By selectively driving a particular drive circuit 12, the corresponding thermal element is heated and color is imparted to the corresponding position of the heat sensitive paper. By making the drive circuit 12 a NAND gate, the circuit can be logically operated. That is, when the strobe signal is inactive (high), drive circuit 12 operation is prohibited. This circuit can easily achieved by connecting the data and strobe signal (positive logic) to the npn transistor base using a wired OR circuit configuration.

Four strobe signals /St1 to /St4 are generated by a delay circuit not shown in the figure. The inverse (positive logic) of these strobe signals /St1 to /St4 and data (positive logic) passed through a latch register are input to drive circuits 12, which are driven based on both signal levels. More specifically, when a value of "1" meaning "print" is applied as the print pixel data, and the strobe signal goes from high to low, that is, changes to a valid state, the NAND gate drive circuit 12 outputs low. This produces a potential difference to the head power supply voltage in the thermal element, which thus heats, exposing the corresponding area of the thermal paper to a heat pulse, thus producing color. The strobe signal is supplied as a signal of which the pulse width is divided into three or four parts. This is described in further detail below. It should be noted that the four strobe signals /St1 to /St4 can be applied with the output timing thereof shifted by a delay circuit, and voltage drop problems arising when a large number of drive circuits go high simultaneously can thus be avoided.

A print head unit 10 installed in a printer according to this preferred embodiment has a shift register 13 and latch register 14 for temporarily storing one line of print pixel data. One line of print pixel data is input to the shift register 13 synchronized to a clock signal and held. It should be noted that while this print pixel data is data corresponding to the pixels printed in one line, it more specifically is data indicating whether current is applied to the thermal element for a particular pixel in the line. Even more specifically, this data is a bit sequence of 1s meaning "print" and 0s meaning "don't print." As further described below, the print pixel data input to the shift register 13 at a specific strobe period is obtained by applying a specific logic operation to the current print pixel data and the past print pixel data. The latch register 14 is parallel connected to the shift register 13, and the bit data in the shift register is simultaneously parallel transferred to and stored in a corresponding memory area. This makes it possible to input the print pixel data for the next strobe period to the shift register 13 during this same period. The data transfer timing from the shift register 13 to the latch register 14 is controlled by the input timing to the latch register 14 of a latch signal L output from a control circuit as described below. This timing is after the previous strobe period and before the next strobe period, and after the print pixel data for the next strobe period has been set in shift register 13.

As noted above, each storage area of the latch register 14 is connected to a drive circuit 12 input terminal. When new data is captured by the latch register 14 due to latch signal L input, the input data to the drive circuit 12 changes immediately according to the new data content. Each drive circuit 12 drives a corresponding thermal element of the heat emitting body 11 according to the latch register 14 data when the delayed strobe signal applied thereto is low.

Figure 2:
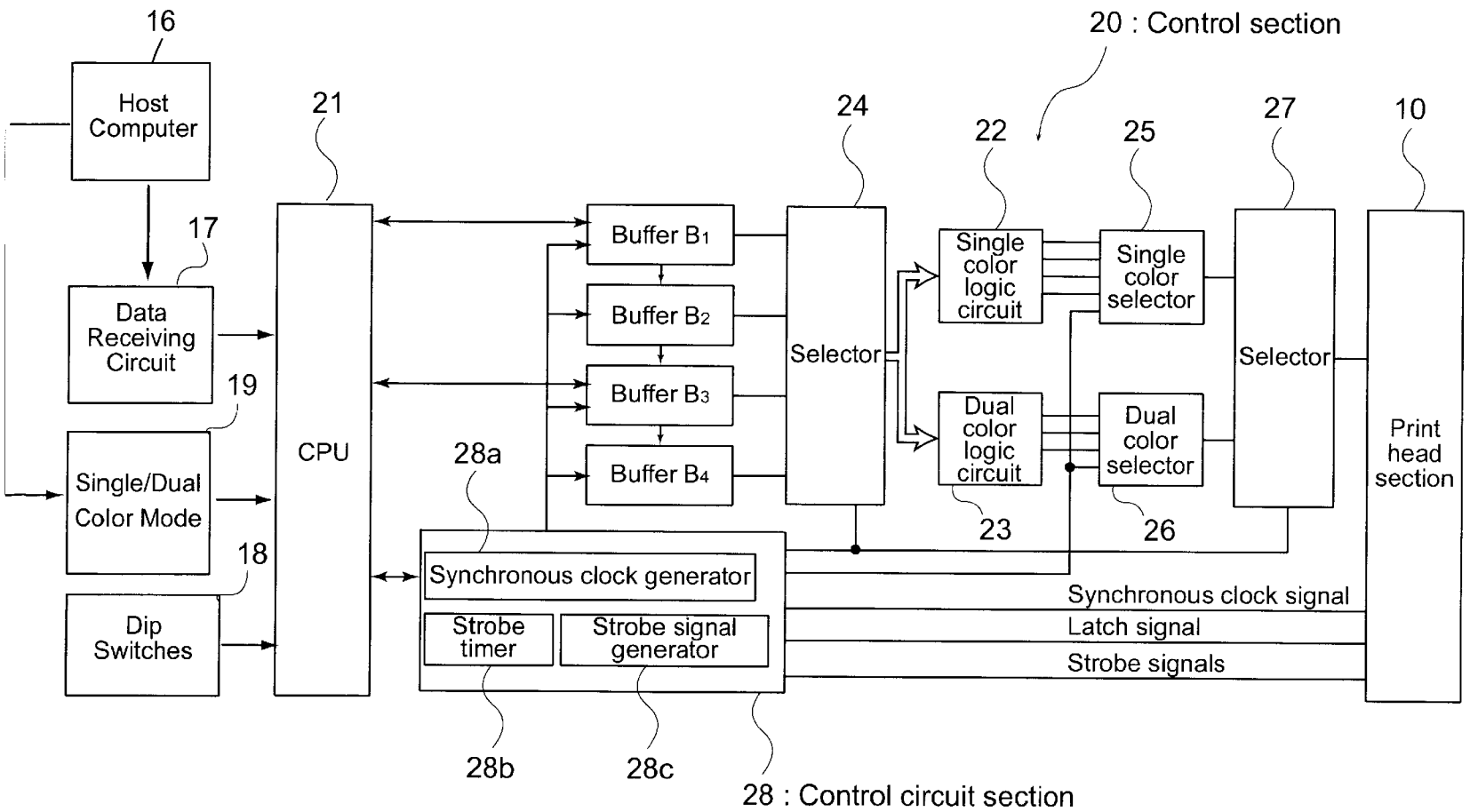
FIG. 2 is a control block diagram of a line thermal printer according to a preferred embodiment of the present invention.

FIG. 2 is a control block diagram of a line thermal printer according to this preferred embodiment of the present invention. Controller 20 basically compensates the print pixel data supplied from a host based on the past print history, and applies the compensated data to print head unit 10. A line thermal printer according to the present invention achieves both single color printing in black, and dual color printing in two different colors such as black and red or black and blue, by changing the setting. A control method for achieving this is described in detail below with reference to the accompanying figures.

Controller 20 in the figure has four logically segmented buffers B1 to B4. These buffers can be reserved using one or a plurality of RAM (random access memory) devices. A print pixel data stream received from the host computer 16 through data receiving circuit 17 is temporarily stored by way of the CPU 21 in these buffers B1 to B4. A line thermal printer according to the present invention has two printing modes, a single color printing mode using black (referred to below as the single color mode), and a dual color printing mode using black and red (referred to below as the dual color mode). It should be noted that the dual color mode is described by way of example below using black and red. In addition, the printing mode can be set using one or more DIP switches 18 provided on the printer, or by sending an appropriate printing mode selection (control) command from the host 16. In the latter case the selected printing mode is preferably stored in a specific place in memory, such as RAM or nonvolatile memory 19, so that it can be referenced for a printing process.

When the printing mode of this line thermal printer is set to the single color mode, the print pixel data stream (color data) to be printed next is stored in the first buffer B1, and the three immediately preceding print pixel data streams, that is, the three previously printed print pixel data streams (also referred to as historical data) are stored in the other three buffers B2 to B4. Therefore, if the next print pixel data is D(n) (where n is a sequential number indicative of the print pixel data order), data D(n) is stored in buffer B1, data D(n−1) is stored in buffer B2, data D(n−2) is stored in buffer B3, and data D(n−3) is stored in buffer B4. Note that past print pixel data is simply shifted from buffer B1 to B2, from B2 to B3, and from B3 to B4. The data to be printed next is passed from the data receiving circuit 17 to buffer B1 where it is stored.

On the other hand, when the printing mode of this line thermal printer is set to the dual color mode, a black print pixel data stream (first color data) and a red print pixel data stream (second color data) are sent sequentially from the host. In other words, current and historical data indicating whether a black pixel is produced or whether a red pixel is produced is separately stored for each color in respective buffers. In this case, the above noted buffers B1 and B2 are used for the black print pixel data with the next print pixel data and the immediately preceding print pixel data stored respectively in buffers B1 and B2, and buffers B3 and B4 are used for the red print pixel data with the next print pixel data and the immediately preceding print pixel data stored respectively in buffers B3 and B4. That is, if the next black print pixel data is Db(n) and the next red print pixel data is Dr(n), then data Db(n) is stored in buffer B1 and Db(n−1) is stored in buffer B2, and data Dr(n) is stored in buffer B3 and Dr(n−1) is stored in buffer B4.

Storing the print pixel data in buffers B1 to B4 is controlled by CPU 21. The CPU 21 thus functions as a memory allocation circuit according to a control program stored in a program ROM (not shown in the figures) to store the current print pixel data and past print pixel data in the buffers appropriate to the selected printing mode.

The controller 20 further comprises two logic circuits, that is, single color logic circuit 22 and dual color logic circuit 23. These logic circuits are selectively used according to the printing mode of the printer by way of selectors 24 and 27. That is, when the printer is set to the single color mode, data from buffers B1 to B4 is input to single color logic circuit 22 by way of selector 24, and the output therefrom as print pixel data to print head unit 10 by way of selector 27. On the other hand, when the printer is set to the dual color mode, data from the buffers B1 to B4 is likewise input to the dual color logic circuit 23 by way of selector 24, and output therefrom as print pixel data to the print head unit 10 by way of selector 27.

When in the single color mode, the single color logic circuit 22 operates in bit units on the historical data and print pixel data input to buffers B1 to B4, and outputs the result in data units of plural bits (4 bits in the figure). As further described below, the strobe period is divided into four different-width periods, and these four bits corresponds to these four period divisions. When a particular bit is set to 1, for example, current is supplied to drive the corresponding thermal element during that bit period, and when a particular bit is set to 0, current is not supplied and the thermal element is therefore not driven.

The single color selector 25 serially outputs these bits to the selector 27 according to a timing signal from the control circuit section 28 that controls the strobe signal timing. This timing signal is synchronized with the synchronous clock signal, latch signal, and strobe signal supplied from the control unit to the print head unit 10, and is generated at each of the period divisions. The specific configuration and operation of the single color logic circuit 22 are further described below.

Likewise in the dual color mode, the dual color logic circuit 23 operates in bit units on the black and red historical data and the black and red print pixel data input to buffers B1 to B4, and outputs the result in data units of plural bits (3 bits in the figure). As in the single color mode, the strobe period is divided into three different width parts, and each output bit corresponds to one of these parts.

The dual color selector 26 serially outputs these bits to the selector 27 according to a timing signal from the control circuit section 28 that controls the strobe signal timing. The specific configuration and operation of the dual color logic circuit 23 are further described below.

Control circuit section 28 comprises a synchronous clock generator 28*a,* strobe timer 28*b,* and strobe signal generator 28*c* for various aspects of printer control. More specifically, data input/output to/from buffers B1 to B4 and switching of selectors 24 to 27 are accomplished, and the synchronization clock, latch signals, and strobe signals applied to the print head unit 10 are generated, as a result of control signals from the control circuit section 28.

Figure 3:
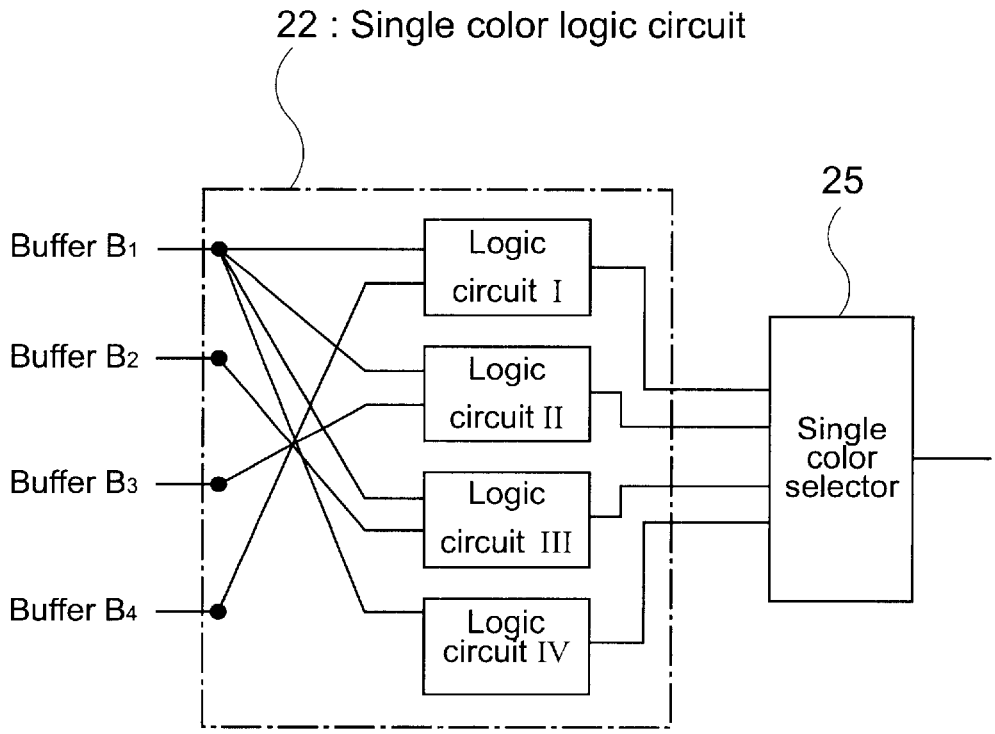
FIG. 3 is a block diagram showing an exemplary internal configuration of a monochrome logic circuit.

FIG. 3 is a block diagram of an exemplary internal configuration of single color logic circuit 22. As shown in the figure, single color logic circuit 22 comprises four logic circuits I, II, III, and IV. Selected data from buffers B1 to B4 is input to each logic circuit, which perform the operations shown below and output one bit.

$$OI=D(n)\bullet\overline{D(n-3)}$$

$$OII=D(n)\bullet\overline{D(n-2)}$$

$$OIII=D(n)\bullet\overline{D(n-1)}$$

$$OIV=D(n) \qquad \text{Equation 1}$$

where "•" means a logical product; OI is the output from logic circuit I, OII is the output from logic circuit II, etc.; D(n) is the pixel data to be printed next (bit data from buffer B1); D(n−1) is the pixel data from the previous line (bit data from buffer B2); D(n−2) is the pixel data from two lines previous (bit data from buffer B3); and D(n−3) is the pixel data from three lines previous (bit data from buffer B4). Therefore, if D(n)=1, D(n−1)=1, D(n−2)=0, and D(n−3)=1, for example, (where 1 means print), the logic circuit output values are OI=0, OII=1, OIII=0, and OIV=1.

Figure 4:
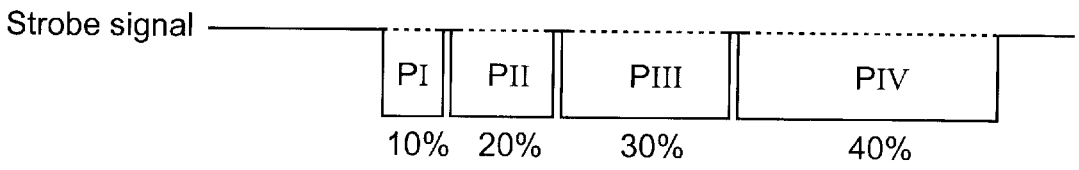
FIG. 4 is an example of a strobe signal in a monochrome printing mode.

These values are output in sequence from the first bit OI by single color selector 25, and a 0101 bit stream corresponding to one dot is thus applied to the print head unit 10. As noted above, each of these bits corresponds to one of the four strobe period divisions. As shown in FIG. 4, in the case of single color printing, the control circuit section 28 continuously outputs four pulses PI, PII, PIII, and PIV of different pulse widths as the strobe signal. The sum of these four pulses equals the entire strobe period, and each pulse can be thought of as one division or part of the strobe period.

The optimum ratio between these pulse widths will depend upon the heat capacity of the thermal head and the characteristics of the recording medium, and is therefore preferably determined from experience. In this exemplary embodiment of our invention we use the following ratio: PI:PII:PIII:PIV=1:2:3:4. The bit sequence output from single color selector 25 corresponds to the individual pulses of this strobe signal. Therefore, a pulse is applied to the corresponding drive circuit 12 when the bit for that pixel is set to 1, and current is therefore supplied to the corresponding thermal element for the length of the pulse width. When the above noted 0101 is input to print head unit 10, only pulses II and IV are applied and the heat energy applied to the corresponding thermal element is determined according to the cumulative time of the pulse periods.

Figure 5:
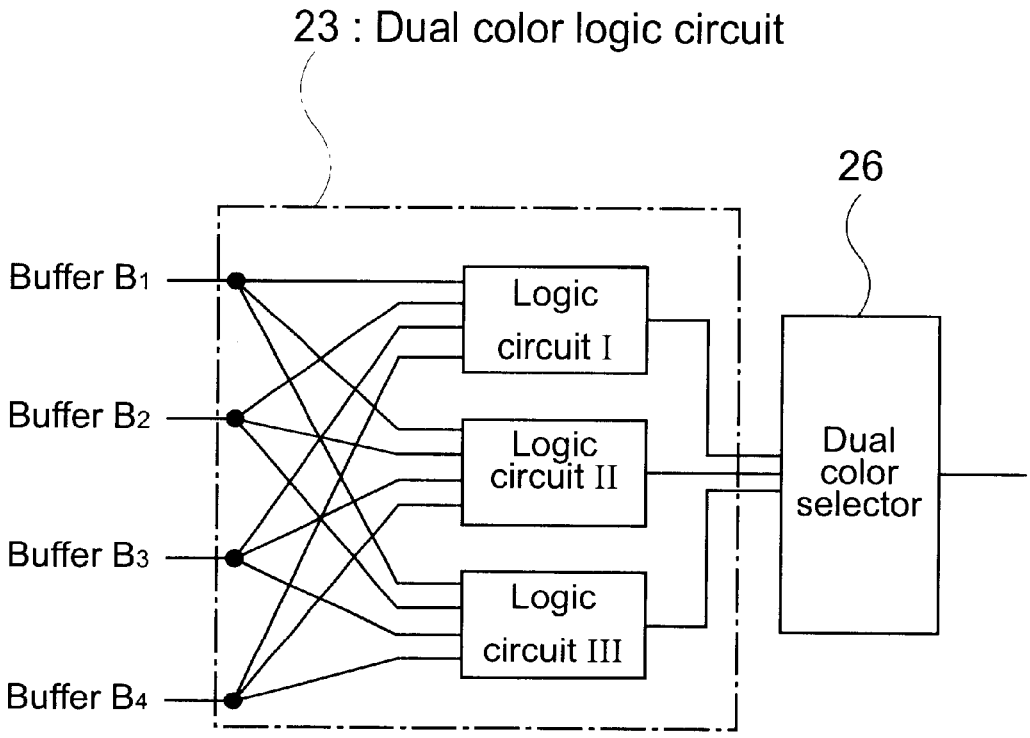
FIG. 5 is a block diagram showing an exemplary internal configuration of a two-color logic circuit.

FIG. 5 is a block diagram of an exemplary internal configuration of dual color logic circuit 23. As shown in the figure, dual color logic circuit 23 comprises three logic circuits I, II, and III. All data from buffers B1 to B4 is input to each logic circuit, which perform. the operations shown below and output one bit.

$$OI=(Db(n)+Dr(n))\bullet\overline{Dr(n-1)}$$

$$OII=(Db(n)+Dr(n))\bullet\overline{Db(n-1)}$$

$$OIII=Db(n) \qquad \text{Equation 2}$$

where "•" means a logical product; "+" means a logical sum; OI is the output from logic circuit I, OII is the output from logic circuit II, etc.; Db(n) is the black pixel data to be printed next (bit data from buffer B1); Db(n−1) is the black pixel data from the previous line (bit data from buffer B2); Dr(n) is the red pixel data to be printed next (bit data from buffer B3); and Dr(n−1) is the red pixel data from the previous line (bit data from buffer B4). Therefore, if Db(n)=1, Db(n−1)=0, Dr(n)=0, and Dr(n−1)=1, for example, (where 1 means print), the output values are OI=0, OII=1, and OIII=1.

Figure 6:
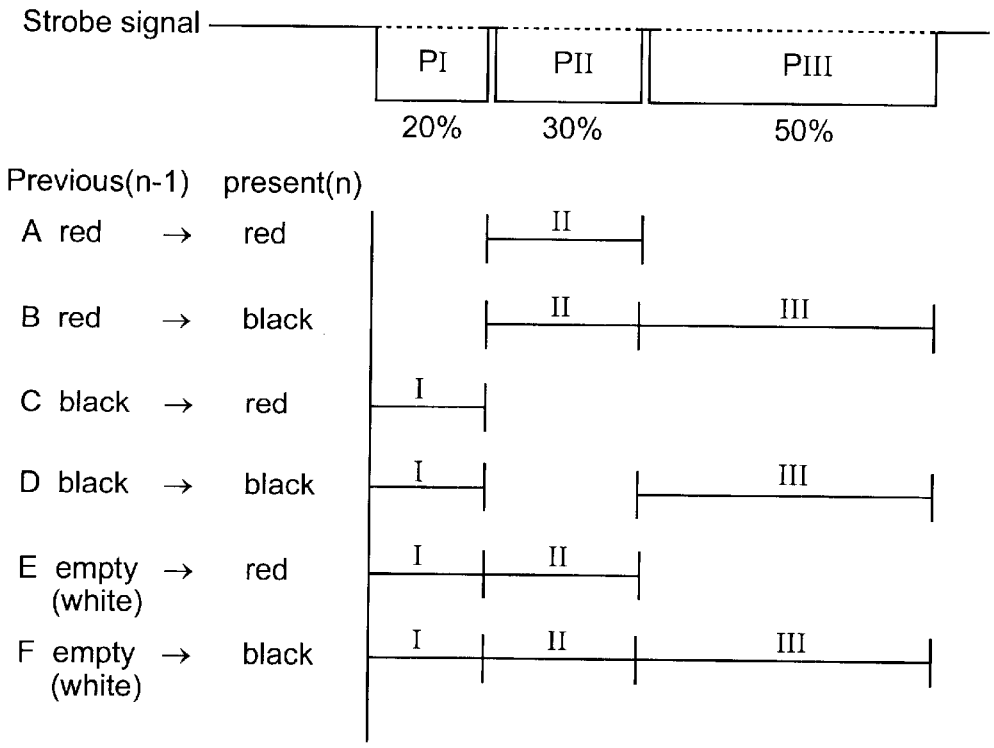
FIG. 6 is an example of a strobe signal in a two-color printing mode.

These values are output in sequence from the first bit OI by dual color selector 26 so that a 011 bit stream is applied to the print head unit 10 as the print data for one dot (thermal element). In the case of two color printing, the control circuit section 28 continuously outputs three pulses PI, PII, and PIII of different pulse widths as shown in FIG. 6. As noted above, the ratio between these pulse widths is experimentally determined, and in this exemplary embodiment is PI:PII:PIII=2:3:5.

The bit sequence output from dual color selector 26 corresponds to the individual pulses of this strobe signal, and pulses are therefore applied where the bit is set to 1. When the above noted 011 bit sequence is input to print head unit 10, only pulses II and III are applied and the heat energy applied to the corresponding thermal element is determined according to the cumulative pulse width. It should be noted that pulse widths determined according to the combination of previous and present print pixel data are shown as A–F in FIG. 6.

It should be noted that the printing speed of a line thermal printer can be made slower during dual color printing than during single color printing. This is to improve print quality in the dual color mode and make the print quality in both modes as nearly the same as possible because the three previous print data are considered for print data compensation when printing in the single color printing mode, but print data from only the one previous line is considered during two color printing.

Figure 7:
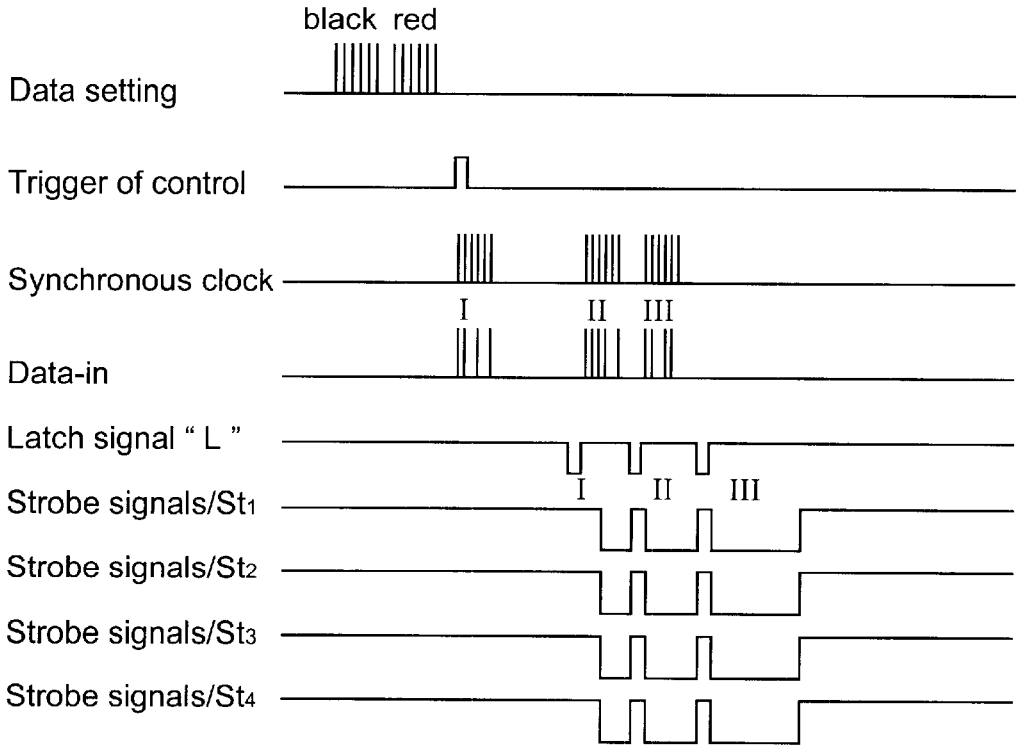
FIG. 7 is a control signal timing chart in a two-color printing mode.

FIG. 7 is a control signal timing chart in the dual color printing mode. As shown in the figure, a pixel data stream for printing black and a pixel data stream for printing red are sequentially sent from the host as one line of print pixel data in the dual color printing mode. This data is received by a data receiving circuit (not shown in the figures) and stored in buffers B1 and B3, respectively, by the CPU 21 (CPU data setting). Based on a control start trigger from control circuit section 28, the operating results from dual color logic circuit 23 are applied to shift register 13 of print head unit 10 as the print data (data in). An output data stream from logic circuit I is applied first as the data-in signal, and the output data streams from logic circuit II and logic circuit III are thereafter applied at a specific timing.

When the output data stream from logic circuit I is applied at the data-in timing, latch signal L causes the data stream to be latched by latch register 14 and applied to drive circuit 12. Next, pulse I is applied to strobe signals /St1 to /St4, and drive circuit 12 is driven according to the data sequence stored in latch register 14.

Parallel to pulse PI input to strobe signals /St1 to /St4, the output data from logic circuit II is applied to shift register 13. The data stored in latch register 14 is then replaced by the data from logic circuit II at the next latch signal L. Pulse II is then applied to strobe signals /St1 to /St4, and drive circuit 12 is driven according to the data stored in latch register 14. Drive circuit 12 is likewise driven for the pulse time (pulse III) of the next strobe signal according to the output data from logic circuit III. One line of dots is thus formed.

As described above, the strobe pulse count, that is, the number of strobe period divisions, and the strobe pulse width are different in the single color print mode and the dual color print mode. In this exemplary embodiment of our invention the CPU 21 changes the strobe pulse characteristics by changing the setting of the strobe timer 28*b* in the control circuit section 28 based on which printing mode is selected. It will be obvious, however, that the present invention shall not be so limited. The same effect can be achieved by generating plural strobe pulses according to the printing mode and selectively supplying the strobe pulses according to which printing mode is selected.

It should be further noted that selector 27 is a simple data selector for switching between output from the single color selector 25 and output from the dual color selector 26 according to a selection signal based on the printing mode selection data. This selection signal is generated and supplied by the CPU 21 through intervening control circuit section 28.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

Figure 8:
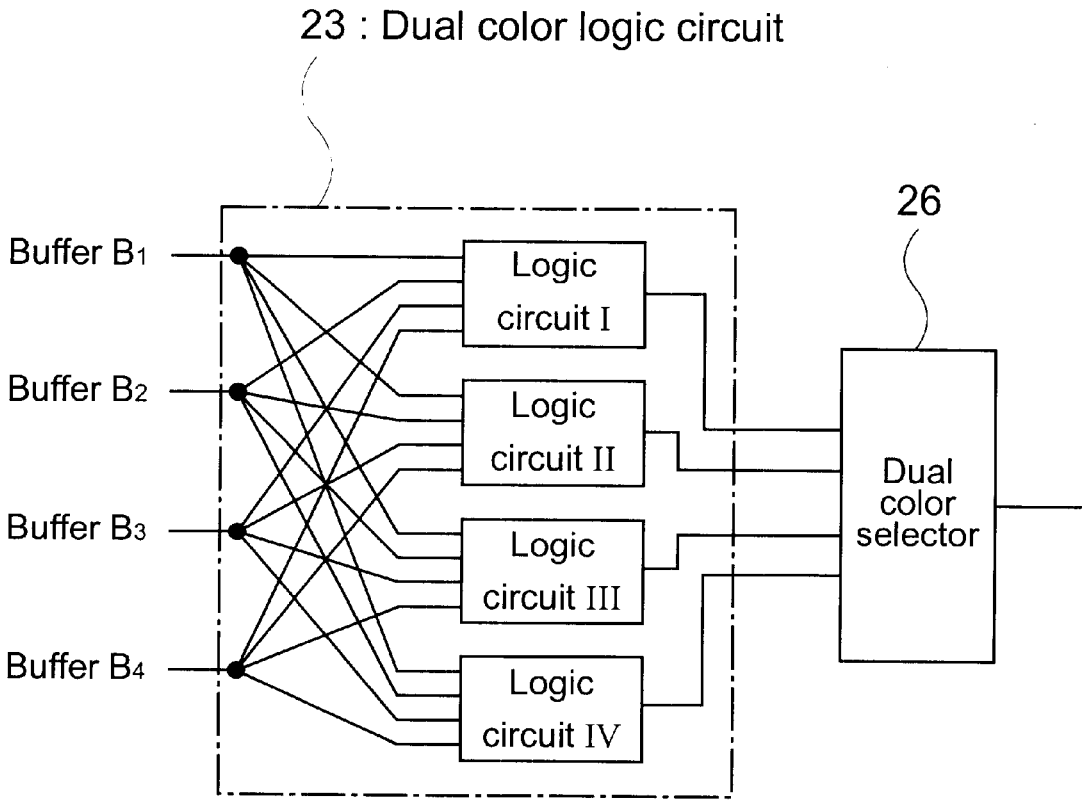
FIG. 8 is a block diagram showing another embodiment of a two-color logic circuit.

FIG. 8 is a block diagram of another embodiment of a two-color logic circuit 23. In this embodiment the data stream output to the print head unit is generated by the four logic circuits I, II, III, and IV. In this case the strobe signal comprises four signals of different pulse widths, and two-color logic circuit 23 generates and outputs four bits of data for each one dot. All data from buffers B1 to B4 is input to logic circuits I, II, III, and IV, respectively, which perform the operations shown below and output one bit.

$$OI=(Db(n)+Dr(n))\cdot\overline{Dr(n-1)}$$

$$OII=(Db(n)+Dr(n))\cdot\overline{Db(n-1)}$$

$$OIII=Db(n)+Dr(n)$$

$$OIV=Db(n) \qquad \text{Equation 3}$$

Figure 9:
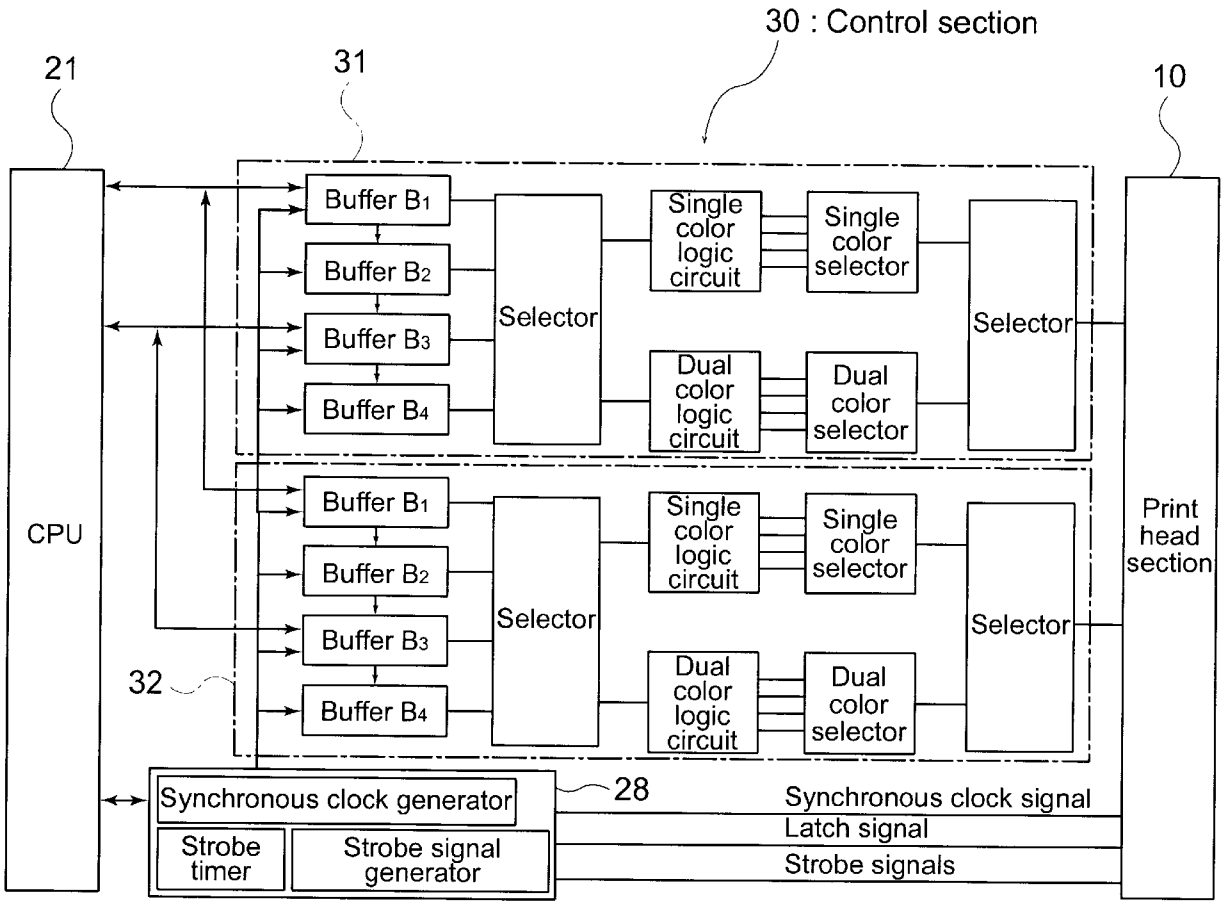
FIG. 9 is a block diagram of a controller according to a yet further embodiment of the present invention.
Figure 10:
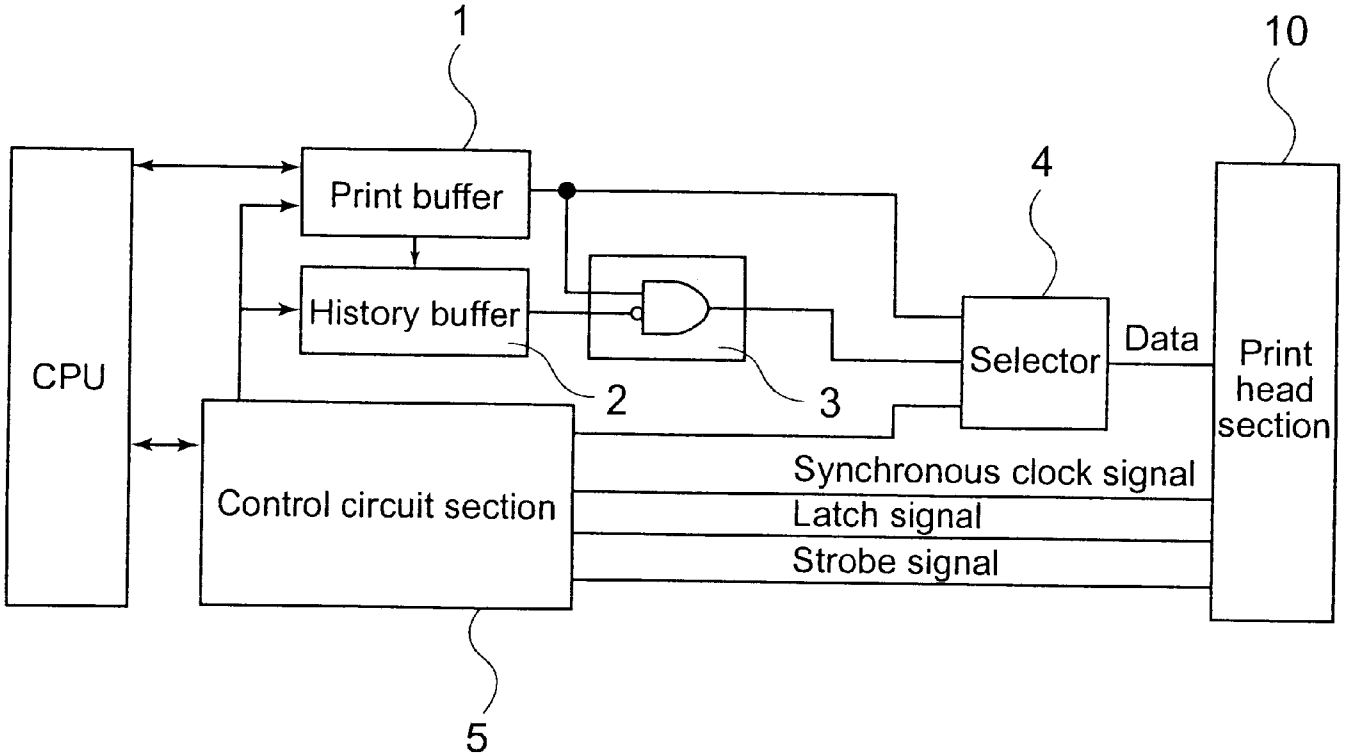
FIG. 10 is a control block diagram of a conventional line thermal printer that takes into account a printing history.

FIG. 9 is a block diagram of a controller according to another embodiment of the present invention. This example is compatible with dividing the print data stream applied to the print head unit 10 in two and applying these in parallel. That is, while not shown in the figure, the print head unit shift register is logically divided in two so that print data streams are captured in parallel, and data applied to the separate areas of the shift register is generated by controller 30.

The controller 30 basically comprises parallel data processing parts of controller 20 shown in FIG. 2. That is, data processing part 31 and data processing part 32 each handle half of the print pixel data stream for one line, and each logic circuit compensates for this and outputs to print head unit 10. The function of the constituent parts of data processing parts 31 and 32 are identical to those of the previous embodiment, and further description thereof is omitted here.

A preferred embodiment of the present invention has been described above with reference to the accompanying figures, but the present invention shall not be limited to the items shown in the above noted embodiments, and shall include the scope of any modifications and applications which will be possible to one in the industry based on the scope of the patent claims, the detailed description of the invention, and the known technology. Four logic buffers are provided in the above-noted embodiment, but the present invention can also be achieved by using at least two buffers. That is, in the case of monochrome printing, the data to be printed next and the previous data are stored in the buffers; in the case of two color printing, one buffer can be used for printing black, and the other buffer can be used for printing red.

Effects of the invention

A line thermal printer capable of switching between high quality printing in one color taking into account a printing history, and printing in multiple colors, can be achieved by means of the present invention as described above. In this case a buffer for storing print pixel data can be efficiently shared between monochrome printing and multicolor printing.

Furthermore, print quality can be made the same in both modes in a printer comprised according to the present invention to switch the printing speed according to whether the printer is set to a monochrome printing mode or a multicolor printing mode.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A thermal printer that prints on a recording medium in which plural colors can be produced depending upon the heat energy applied to the recording medium, comprising:

a thermal element that produces the plural colors;

a thermal element drive circuit that drives the thermal element;

a receiving circuit that receives color data specifying either no color or one of said plural colors;

memory that stores the color data received by the receiving circuit; and a drive control circuit that supplies a particular drive signal to the thermal element drive circuit based on the current color data received by the receiving circuit, and previous color data stored in the memory; and wherein the drive control circuit comprises:

a strobe signal generator that generates a strobe signal and defines a plural part strobe period of the drive circuit, the strobe signal comprising one or more of at least three individual pulses having different pulse widths from each other; and a logic circuit that determines whether or not one of the at least three individual pulses is applied to drive the thermal element during a corresponding one of the plural parts of the strobe period based on at least presence or absence of current first color data stored in said memory, presence or absence of previous first color data stored in said memory, presence or absence of current second color data stored in said memory, and presence or absence of previous second color data stored in said memory.

2. A thermal printer as in claim 1, wherein the memory comprises a first storage part for storing first color data based on color data received by the receiving circuit, and a second storage part for storing second color data based on color data received by the receiving circuit.

3. A thermal printer as in claim 2, wherein the first storage part of the memory stores current and previous first color data, and the second storage part of the memory stores current and previous second color data.

4. A thermal printer as in claim 1, further comprising a color mode setting circuit for setting a color mode, and a memory allocation circuit for determining the color data to be stored in memory according to the color mode set by the color mode setting circuit, wherein the drive control circuit supplies a different control signal to the thermal element drive circuit according to the color mode set by the color mode setting circuit.

5. A thermal printer as in claim 4, wherein the color mode setting circuit sets one of a single and dual color mode and when the dual color mode is set, the memory allocation circuit stores in said memory first color data and second color data, based on color data received by the receiving circuit, and when the single color mode is set, the memory allocation circuit stores only first color data in said memory based on the color data received by the receiving circuit.

6. A thermal printer as in claim 5, wherein when the dual color mode is set, the memory allocation circuit stores in said memory current and previous first color data and current and previous second color data, based on color data received by the receiving circuit, and when the single color mode is set, the memory allocation circuit stores current first color data, previous first color data, and preceding previous color data in said memory.

7. A thermal printer as in claim 4, wherein the drive control circuit sets the period from one strobe to the next strobe according to the color mode set by the color mode setting circuit.

8. A thermal printer as in claim 1, wherein the drive control circuit comprises a first strobe period dividing circuit for dividing a drive circuit strobe period into first specific plural parts, a first logic circuit for determining whether current is applied to the thermal element during the first specific plural parts based on at least presence or absence of current first color data stored in said memory, presence or absence of previous first color data stored in said memory, presence or absence of current second color data stored in said memory, and presence or absence of previous second color data stored in said memory;

a second strobe period dividing circuit for dividing the drive circuit strobe period into second specific plural parts, and a second logic circuit for determining whether current is applied to the thermal element during the second specific plural parts based on at least presence or absence of current first color data stored in said memory, and presence or absence of previous first color data stored in said memory, wherein when the dual color mode is set, the drive control circuit selects the first strobe period dividing circuit and first logic circuit, and when the single color mode is set, the drive control circuit selects the second strobe period dividing circuit and second logic circuit.

9. A thermal printer as in claim 1, wherein the strobe signal comprises one or more of a first pulse I, a second pulse II, and a third pulse III, and wherein the relationship in pulse width between the first pulse I, the second pulse II, and the third pulse III is small, intermediate, and large, respectively.

10. A thermal printer as in claim 9, wherein the logic circuit comprises a first logic circuit I, a second logic circuit II, and a third logic circuit III, and the logic circuit determines whether or not to apply the first pulse I, the second pulse II, and the third pulse III during a corresponding one of the plural parts of the strobe period according to the following equations:

$$OI=(Db(n)+Dr(n))\bullet\overline{Dr(n-1)}$$

$$OII=(Db(n)+Dr(n))\bullet\overline{Db(n-1)}$$

$$OIII=Db(n)$$

where "•" denotes a logical product; "+" denotes a logical sum; OI is an output from logic circuit I, OII is an output from logic circuit II, OIII is an output from logic circuit III; Db(n) is black pixel data to be printed next; Db(n−1) is black pixel data from a previous line; Dr(n) is red pixel data to be printed next; and Dr(n−1) is red pixel data from the previous line.

11. A thermal printer as in claim 1, wherein the strobe signal comprises one or more of a first pulse I, a second pulse II, a third pulse III, and a fourth pulse IV, and wherein the relationship in pulse width between the first pulse I, the second pulse II, the third pulse III, and the fourth pulse IV is small, large, larger, and largest, respectively.

12. A thermal printer as in claim 11, wherein the logic circuit comprises a first logic circuit I, a second logic circuit II, a third logic circuit III, and a fourth logic circuit IV, and the logic circuit determines whether or not to apply the first pulse I, the second pulse II, the third pulse III, and the fourth pulse IV during a corresponding one of the plural parts of the strobe period according to the following equations:

$$OI=(Db(n)+Dr(n))\bullet\overline{Dr(n-1)}$$

$$OII=(Db(n)+Dr(n))\bullet\overline{Db(n-1)}$$

$$OIII=Db(\mathrm{n})+Dr(n)$$

$$OIV=Db(n)$$

where "•" denotes a logical product; "+" denotes a logical sum; OI is an output from logic circuit I, OII is an output from logic circuit II, OIII is an output from logic circuit III; OIV is an output from logic circuit IV; Db(n) is black pixel data to be printed next; Db(n−1) is black pixel data from a previous line; Dr(n) is red pixel data to be printed next; and Dr(n−1) is red pixel data from the previous line.

13. A thermal history control method for a thermal printer that produces plural colors according to the level of heat energy applied to a recording medium, comprising:

receiving color data specifying either no color or one of said plural colors;

storing the color data received in the receiving step; and generating a color based on current color data received in the receiving step, and previous color data stored in the storing step; and wherein the color generating step comprises generating a strobe signal and dividing a strobe period for color generation into plural parts, the strobe signal comprising one or more of at least three individual pulses having different pulse widths from each other; and determining whether or not to apply one of the at least three individual pulses to drive a thermal element during a corresponding one of the plural strobe period parts based on at least:

presence or absence of current first color data, presence or absence of a previous first color data, presence or absence of current second color data, and presence or absence of a previous second color data.

14. A thermal history control method as in claim 13, wherein the storing step comprises:

storing first color data based on color data received in the receiving step, and storing second color data based on color data received in the receiving step.

15. A thermal history control method as in claim 14, wherein the storing step comprises storing current and previous first color data, and current and previous second color data.

16. A thermal history control method as in claim 13, further comprising setting a color mode, and determining the color data to be stored in memory according to the color mode set by the color mode setting step, and wherein the color generating step supplies current to a thermal element to produce a color according to the color mode set by the color mode setting step.

17. A thermal history control method as in claim 16, wherein the color mode setting step sets one of a single and dual color mode, and when a dual color mode is set, the storing step stores first color data, and second color data based on color data received by the receiving step, and when a single color mode is set, the storing step stores only the first color data based on the color data received in the receiving step.

18. A thermal history control method as in claim 17, wherein when the dual color mode is set, the storing step stores current and previous first color data, and current and previous second color data, and when the single color mode is set, the storing step stores only current and previous first color data.

19. A thermal history control method as in claim 16, wherein the color generating step comprises a first strobe period dividing step for dividing a strobe period for producing color into first specific plural parts, a first logic operating step for determining whether current is applied to the thermal element during the first specific plural parts based on at least presence or absence of a current first color data stored in the storing step, presence or absence of previous first color data stored in the storing step, presence or absence of current second color data stored in the storing step, and presence or absence of previous second color data stored in the storing step;

a second strobe period dividing step for dividing the strobe period for producing color into second specific plural parts, and a second logic operating step for determining whether current is applied to the thermal element during the second specific plural parts based on at least presence or absence of current first color data stored in the storing step, and presence or absence of previous first color data stored in the storing step;

where when the dual color mode is set, the color generating step selects the first strobe period dividing step and first logic operating step, and when the single color mode is set, the color generating step selects the second strobe period dividing step and second logic operating step.

20. A thermal history control method as in claim 16, wherein the color generating step sets the period from one strobe to the next strobe according to the color mode set by the color mode setting step.

21. A thermal history control method as in claim 13, wherein the strobe signal comprises one or more of a first pulse I, a second pulse II, and a third pulse III, and wherein the relationship in pulse width between the first pulse I, the second pulse II, and the third pulse III is small, intermediate, and large, respectively.

22. A thermal history control method as in claim 21, wherein the determining step comprises a first determining step I, a second determining step II, and a third determining step III, and the determining step determines whether or not to apply the first pulse I, the second pulse II, and the third pulse III during a corresponding one of the plural parts of the strobe period according to the following equations:

$$OI=(Db(n)+Dr(n))\bullet\overline{Dr(n-1)}$$

$$OII=(Db(n)+Dr(n))\bullet\overline{Db(n-1)}$$

$$OIII=Db(n)$$

where "•" denotes a logical product; "+" denotes a logical sum; OI is an output from determining step I, OII is an output from determining step II, OIII is an output from determining step III; Db(n) is black pixel data to be printed next; Db(n−1) is black pixel data from a previous line; Dr(n) is red pixel data to be printed next; and Dr(n−1) is red pixel data from the previous line.

23. A thermal history control method as in claim 13, wherein the strobe signal comprises one or more of a first pulse I, a second pulse II, a third pulse III, and a fourth pulse IV, and wherein the relationship in pulse width between the first pulse I, the second pulse II, the third pulse III, and the fourth pulse IV is small, large, larger, and largest, respectively.

24. A thermal history control method as in claim 23, wherein the determining step comprises a first determining step I, a second determining step II, a third determining step III, and a fourth determining step IV, and the determining step determines whether or not to apply the first pulse I, the second pulse II, the third pulse III, and the fourth pulse during a corresponding one of the plural parts of the strobe period according to the following equations:

$$OI=(Db(n)+Dr(n))\bullet\overline{Dr(n-1)}$$

$$OII=(Db(n)+Dr(n))\bullet\overline{Db(n-1)}$$

$$OIII=Db(n)+Dr(n)$$

$$OIV=Db(n)$$

where "•" denotes a logical product; "+" denotes a logical sum; OI is an output from determining step I, OII is an output from determining step II, OIII is an output from determining step III; OIV is an output from determining step IV; Db(n) is black pixel data to be printed next; Db(n−1) is black pixel data from a previous line; Dr(n) is red pixel data to be printed next; and Dr(n−1) is red pixel data from the previous line.

* * * * *